US007913603B2

(12) United States Patent
LaGrange et al.

(10) Patent No.: US 7,913,603 B2
(45) Date of Patent: Mar. 29, 2011

(54) DEVICE AND METHODS FOR FIRING PERFORATING GUNS

(75) Inventors: Timothy Edward LaGrange, Rainbow, TX (US); Lyle W. Andrich, Grandview, TX (US)

(73) Assignee: Owen Oil Tolls LP, Houston, TX (US)

( * ) Notice: Subject to any disclaimer, the term of this patent is extended or adjusted under 35 U.S.C. 154(b) by 665 days.

(21) Appl. No.: 11/069,600

(22) Filed: Mar. 1, 2005

(65) Prior Publication Data

US 2006/0196665 A1 Sep. 7, 2006

(51) Int. Cl.
*E21B 34/06* (2006.01)

(52) U.S. Cl. ..... 89/1.15; 166/373

(58) Field of Classification Search ..... 89/1.15, 89/1.151; 166/373, 374
See application file for complete search history.

(56) References Cited

U.S. PATENT DOCUMENTS

| | | | | |
|---|---|---|---|---|
| 2,171,384 | A | | 8/1939 | Young |
| 2,238,939 | A | | 4/1941 | Lewis et al. |
| 2,377,151 | A | | 5/1945 | Huber |
| 2,558,163 | A | | 6/1951 | Wright et al. |
| 2,590,671 | A | | 3/1952 | Baker |
| 2,819,673 | A | * | 1/1958 | Cecil et al. ..... 102/331 |
| 2,935,020 | A | | 5/1960 | Howard et al. |
| 3,013,492 | A | | 12/1961 | Sexton |
| 3,057,296 | A | | 10/1962 | Silverman |
| 3,131,633 | A | | 5/1964 | Eisler et al. |
| 3,246,602 | A | | 4/1966 | Meredith et al. |
| 3,422,760 | A | | 1/1969 | Mohaupt |
| 3,926,119 | A | | 12/1975 | Hurst et al. |
| 4,074,629 | A | | 2/1978 | Colgate |
| 4,215,631 | A | | 8/1980 | Rucker |
| RE30,621 | E | | 5/1981 | Calder et al. |
| 4,329,925 | A | | 5/1982 | Hane et al. |
| 4,382,410 | A | | 5/1983 | Bowling et al. |
| 4,425,850 | A | | 1/1984 | Grossler |
| 4,485,876 | A | * | 12/1984 | Speller ..... 166/373 |
| 4,544,034 | A | * | 10/1985 | George ..... 166/297 |
| 4,612,992 | A | * | 9/1986 | Vann et al. ..... 166/297 |
| 4,614,156 | A | | 9/1986 | Colle, Jr. et al. |
| 4,649,822 | A | | 3/1987 | Seeman |
| 4,798,244 | A | | 1/1989 | Trost |
| 4,850,438 | A | * | 7/1989 | Regalbuto ..... 175/4.56 |
| 5,062,485 | A | | 11/1991 | Wesson et al. |
| 5,078,210 | A | | 1/1992 | George |
| 5,099,763 | A | | 3/1992 | Coursen et al. |
| 5,155,293 | A | | 10/1992 | Barton |
| 5,287,924 | A | * | 2/1994 | Burleson et al. ..... 166/297 |
| 5,353,875 | A | | 10/1994 | Schultz |
| 5,355,957 | A | | 10/1994 | Burleson et al. |

(Continued)

*Primary Examiner* — Stephen M Johnson
(74) *Attorney, Agent, or Firm* — Mossman, Kumar & Tyler, PC

(57) ABSTRACT

A perforating gun train for perforating two or more zones of interest includes two or more gun sets made up of guns, detonators, and other associated equipment. In one embodiment, the gun sets are connected with connectors that can convey activation signals between the gun sets. The firing of a gun set creates this conveyed activation signal either directly or indirectly. In one arrangement, a surface signal initiates the firing of a first gun set while subsequent firings are initiated by firing of the gun sets making up the gun train. An exemplary connector is at least temporarily filled with signal conveyance medium adapted to transmit activation signals between the gun sets. In one embodiment, the signal conveyance medium is a liquid. The liquid can be added to the connector either at the surface or while in the wellbore.

8 Claims, 5 Drawing Sheets

U.S. PATENT DOCUMENTS 5,398,760 A 3/1995 George
5,435,250 A 7/1995 Pollock
5,505,261 A 4/1996 Huber
5,690,171 A 11/1997 Winch et al.
5,887,654 A 3/1999 Edwards et al.
5,890,539 A 4/1999 Huber et al.
5,971,072 A 10/1999 Huber et al.
6,085,843 A * 7/2000 Edwards et al. ..... 166/297
6,182,750 B1 2/2001 Edwards et al.
6,213,203 B1 4/2001 Edwards et al.
6,354,374 B1 3/2002 Edwards et al.
6,631,684 B2 10/2003 Kang
6,666,141 B2 12/2003 Hagerty
6,679,175 B2 1/2004 Gavrilovic
7,104,326 B2 9/2006 Grattan et al.
7,210,409 B2 5/2007 Johnson
7,306,038 B2 12/2007 Challacombe
2001/0027864 A1 10/2001 Vaynshteyn
2003/0150622 A1 * 8/2003 Patel et al. ..... 166/373
2006/0196665 A1 9/2006 LaGrange et al.

* cited by examiner

DEVICE AND METHODS FOR FIRING PERFORATING GUNS

CROSS-REFERENCE TO RELATED APPLICATIONS

None.

BACKGROUND OF THE INVENTION

1. Field of the Invention

The present invention relates to devices and methods for selective actuation of wellbore tools. More particularly, the present invention is in the field of control devices and methods for selective firing of a gun assembly.

2. Description of the Related Art

Hydrocarbons, such as oil and gas, are produced from cased wellbores intersecting one or more hydrocarbon reservoirs in a formation. These hydrocarbons flow into the wellbore through perforations in the cased wellbore. Perforations are usually made using a perforating gun loaded with shaped charges. The gun is lowered into the wellbore on electric wireline, slickline, tubing, coiled tubing, or other conveyance device until it is adjacent the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow through the perforations and into a production string.

Tubing conveyed perforating (TCP) is a common method of conveying perforating guns into a wellbore. TCP includes the use of standard threaded tubulars as well as endless tubing also referred to as coiled tubing.

For coiled tubing perforating systems, the perforating guns loaded with explosive shaped charges are conveyed down hole into the well connected to the end of a tubular work string made up of coiled tubing. One advantage of this method of perforating is that long zones of interest (areas of gas or oil) can be perforated with a single trip into the well. The perforating guns are of a certain length each and are threaded together using a tandem sub. With an explosive booster transfer system placed in the tandem sub, the detonation of one gun can be transferred to the next. This detonation can be initiated from either the top of the gun string or the bottom of the gun string.

TCP can be particularly effective for perforating multiple and separate zones of interest in a single trip. In such situations, the TCP guns are arranged to form perforations in selected zones but not perforate the gap areas separating the zones. If the gap distance is short, the gap area is usually incorporated in the gun string by leaving out a certain number of shaped charges or using blanks. However, the detonating cord carries the explosive transfer to the next loaded area of the gun string.

In wells that have long or substantial gaps between zones, an operator must consider the efficiency and cost of perforating the zones. The zones can be perforated separately via multiple trips into the well, which requires running the work string in and out of the well for each zone to be perforated. This increases rig and personnel time and can be costly.

Referring now to FIG. 1, there is shown another conventional system for perforating multiple zones that includes perforating guns 12 that are connected to each other by tubular work strings 14. Devices such as circulation subs 16 can be used to equalize pressure in the work strings 14. The guns 12 are fired using a detonator body 18 that is actuated by a pressure activated firing head 20. During operation, the operator increases the pressure of the wellbore fluid in the well by energizing devices such as surface pumps. The firing heads 20, which are exposed to the wellbore fluids, sense wellbore fluid pressure, i.e., the pressure of the fluid in the annulus formed by the gun and the wellbore wall. Once a pre-set value of the annulus fluid pressure is reached, the firing heads 20 initiate a firing sequence for its associated gun 12. The firing heads 20 usually incorporate a pyrotechnic time delay 21 to allow operators to exceed the activation pressure of each firing head 20 in the TCP string 10 to ensure each firing head 20 is activated. If the operator cannot increase the pressure in the well, or if one of the firing heads or time delays fails and a zone is not perforated another round trip in the well is required to perforate the zone that was missed on the initial run. Each trip in the well costs time and money.

These conventional firing systems for various reasons, such as capacity, reliability, cost, and complexity, have proven inadequate for certain applications. The present invention addresses these and other drawbacks of the prior art.

SUMMARY OF THE INVENTION

In aspects, the present invention can be advantageously used in connection with a perforating gun train adapted to perforate two or more zones of interest. In an exemplary system, the gun train can include two or more gun sets made up of guns, detonators, and other associated equipment. In one embodiment, the gun sets making up the gun train are connected with connectors that can convey activation signals between the gun sets. The activation signals are created, either directly or indirectly, by the firing of the gun sets. For example, the firing of a first gun set can create an activation signal that is conveyed via a connector to a second gun set, which fires upon receiving the activation signal. The firing of the second gun set, in turn, can cause, either directly or indirectly, an activation signal that is conveyed via a connector to a third gun set, which fires upon receiving the activation signal, and so on. Thus, while the firing of the first gun set is initiated by a surface signal, subsequent firings are initiated by firing of the gun sets making up the gun train.

In one arrangement, the connector includes a signal transmission medium for transferring activation signals between the gun sets. For example, the connector can have a bore filled with fluid that transmits pressure changes caused by firing of the first gun set to the second gun set in a manner similar to a hydraulic line. The connector can be pre-filled with fluid from the surface. Also, a flow control unit can be used to selectively fill the connector with fluid from the wellbore. The flow control unit can include a fill valve that allows the bore to be flooded with wellbore fluid and a vent valve that allows fluid to exit the connector. The fill valve and vent valve can be configured to at least temporarily isolate the fluid in the connector from the fluid in the wellbore to provide the hydraulic connection.

For arrangements using pressure changes as an activation signal between the first gun set and the second gun set, the second gun set can include a pressure activated detonator assembly for initiating firing of the second gun set. The first gun set can be firing by using a pressure signal transmitted by via the fluid in the wellbore, an electrical signal transmitted via a conductor coupled to the detonator of the first gun set, a projectile dropped from the surface, or other suitable method.

In another arrangement, an activator is coupled to the first gun set to produce the activation signal. In one embodiment, the activator includes an energetic material that detonates upon firing of the first gun set. The detonating energetic material causes a pressure change in the fluid in the connector that acts as the activation signal for the detonator of the second gun set. In another embodiment, the activator includes a projectile retained by a retaining device. The retaining device releases the projectile through the connector upon firing of the first gun set. The projectile acts as the activation signal for the detonator of the second gun set.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE INVENTION

Figure 1:
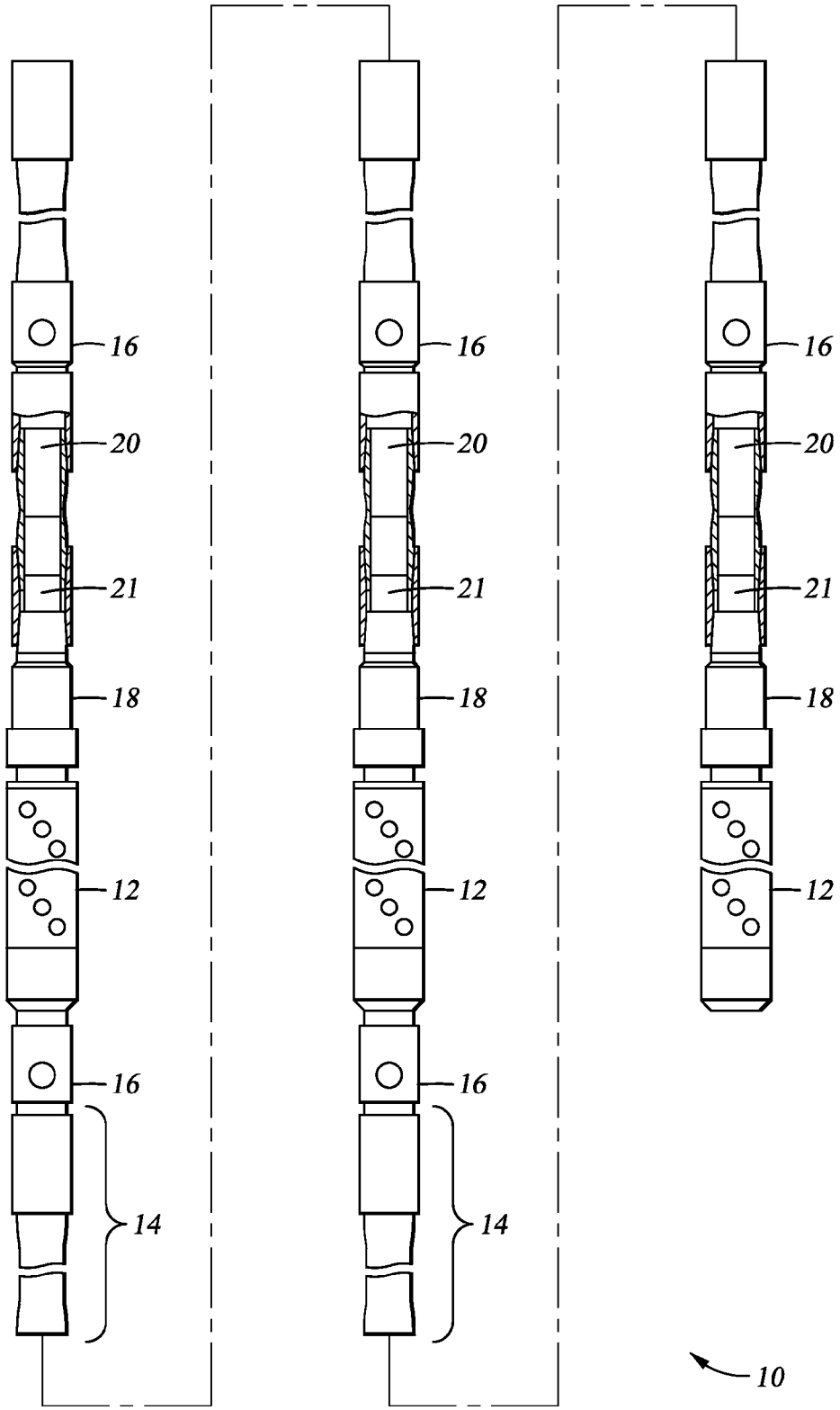
Fig. 1 (PRIOR ART)
FIG. 1 schematically illustrates a conventional perforating gun train.

The present invention relates to devices and methods for firing two or more downhole tools. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Figure 2:
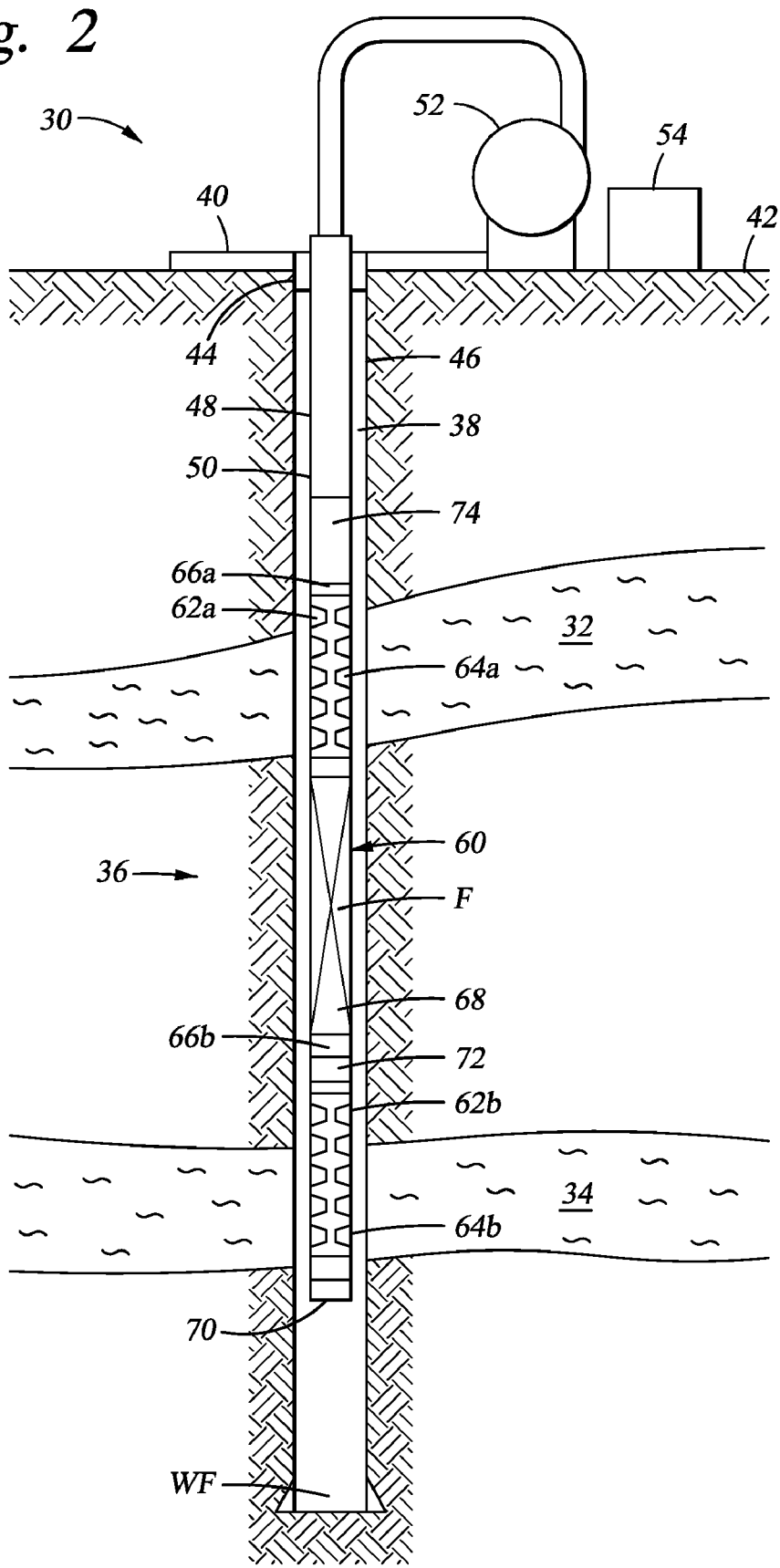
FIG. 2 schematically illustrates a deployment of a perforating gun train utilizing one embodiment of the present invention.

Referring initially to FIG. 2, there is shown a well construction and/or hydrocarbon production facility 30 positioned over subterranean formations of interest 32, 34 separated by a gap section 36. The facility 30 can be a land-based or offshore rig adapted to drill, complete, or service a wellbore 38. The wellbore 38 can include a wellbore fluid WF that is made up of formation fluids such as water or hydrocarbons and/or man-made fluids such as drilling fluids. The facility 30 can include known equipment and structures such as a platform 40 at the earth's surface 42, a wellhead 44, and casing 46. A work string 48 suspended within the well bore 38 is used to convey tooling into and out of the wellbore 38. The work string 48 can include coiled tubing 50 injected by a coiled tubing injector 52. Other work strings can include tubing, drill pipe, wire line, slick line, or any other known conveyance means. The work string 48 can include telemetry lines or other signal/power transmission mediums that establish one-way or two-way telemetric communication from the surface to a tool connected to an end of the work string 48. A suitable telemetry system (not shown) can be known types as mud pulse, electrical signals, acoustic, or other suitable systems. A surface control unit (e.g., a power source and/or firing panel) 54 can be used to monitor and/or operate tooling connected to the work string 48.

In one embodiment of the present invention, a perforating gun train 60 is coupled to an end of the work string 48. An exemplary gun train includes a plurality of guns or gun sets 62*a-b*, each of which includes perforating shaped charges 64*a-b*, and detonators or firing heads 66*a-b*. The guns 62*a-b* are connected to one another by a connector 68. Other equipment associated with the gun train 60 includes a bottom sub 70, a top sub 72, and an accessories package 74 that may carry equipment such as a casing collar locator, formation sampling tools, casing evaluation tools, etc.

The guns 62*a-b* and connector 68 are constructed such that a portion of the energy released by the exploding charges of the gun 62*a* is used to directly or indirectly initiate the firing of gun 62*b*. The connector 68 can be a tubular member, a wire, a cable or other suitable device for physically interconnecting the guns 62*a-b* and can include a signal transmission medium, such as an incompressible fluid or electrical cable, adapted to convey signals across the connector 68.

In a direct initiation, the tubular connector 68 directs an energy wave from the gun 62*a* to the gun 62*b*. For example, the tubular connector 68 can be filled with a fluid F. When the energy released by gun 62*a* impacts the fluid F in the tubular connector 68, the subsequent pressure change moves the fluid. This pressurized fluid movement acts similar to hydraulic fluid in a hydraulic line. This pressurized fluid movement is transferred downward through the tubular connector 68 to a pressure activated firing head device 66*b* for the gun 62*b*. Thus, the pressure change caused by the detonation of the first gun 62*a* acts as an activation signal that activates the firing head 66*b* that in turn detonates the perforating gun 62*b*. The detonation of the gun 62*b* can be used to initiate the firing of additional guns (not shown). That is, the detonation and generation of pressure changes can be repeated. The number of times it is repeated is only dependent on the number of zones or intervals to be perforated. The pressure change can be a pressure increase, a pressure decrease, or a pressure pulse (i.e., a transient increase or decrease). Other suitable signal transmission mediums include conductive cables for conveying electrical signals or fiber optic signals and rigid members for conveying acoustic signals.

Figure 3:
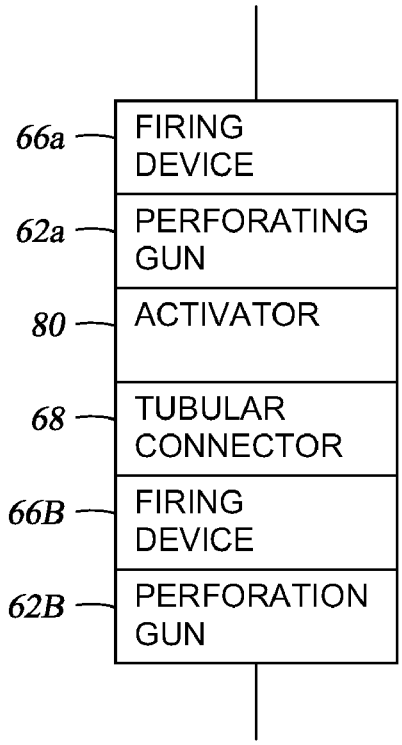
FIG. 3 schematically illustrates one embodiment of the present invention that is adapted to selectively permit transmission of signals to a downhole tool.

Referring now to FIG. 3, the energy released by the gun 62*a* can also be used to indirectly initiate a firing sequence for gun 62*b*. In FIG. 3, an activator 80 is used to initiate the firing sequence for gun 62*b* while the energy released by the gun 62*a* is used to actuate the activator 80. The activator 80 can be actuated explosively, mechanically, electrically, chemically or other suitable method. For example, the energy release may include a high detonation component that detonates material in the activator 80, a pressure component that moves mechanical devices in the activator 80, or a vibration component that jars or disintegrates structural elements in the activator 80.

When actuated, the activator 80 transmits an activation signal, such as a pressure change, electrical signal, or projectile, to the firing head 66*b* of the gun 62*b*. The type of activation signal will depend on the configuration of the firing head 66*b*, i.e., whether it has pressure sensitive sensors, a mechanically actuated pin, electrically actuated contact, etc.

Figure 4A:
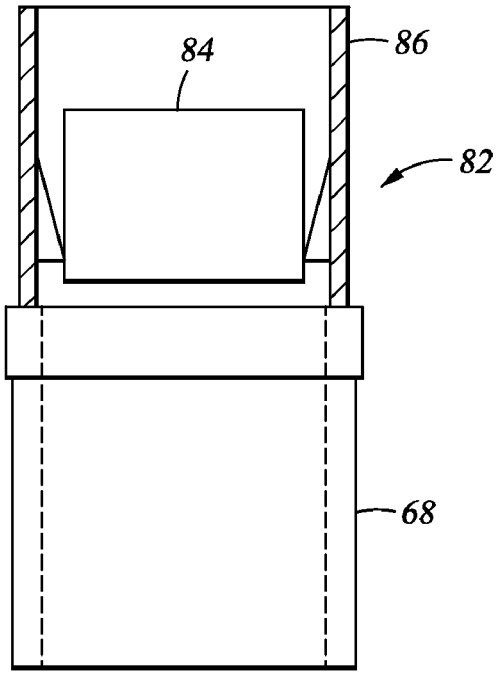
FIG. 4A schematically illustrates another embodiment of the present invention that is adapted to selectively permit transmission of signals to a downhole tool.

Referring now to FIGS. 3 and 4A, there is shown an activator 82 for activating a mechanically actuated firing head. The activator 82 include a projectile 84 such as a metal bar that is retained by a retaining device 86 such as slips, frangible elements, combustible elements or other suitable device. The energy released by the gun 62*a* causes the retaining device 86 to release the projectile 84, which then travels downward via the tubular connector 68 and strikes the firing head 66*b* of the gun 62*b*.

Figure 4B:
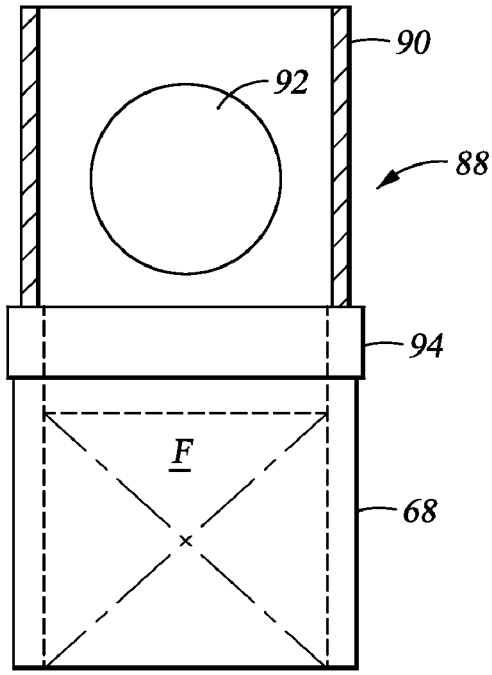
FIG. 4B schematically illustrates another embodiment of the present invention that is adapted to selectively permit transmission of signals to a downhole tool.

Referring now to FIGS. 3 and 4B, there is shown an activator 88 for actuating a pressure sensitive firing head. The activator 88 includes a pressure generator or chamber 90 on the bottom of a gun 62*a*. The tubular member 68 is attached to the gun 62*a* and includes a fluid F. The chamber 90 includes an energetic material 92 such as detonating cord, a black powder charge, or propellant material that produce a rapid pressure increase in the chamber 90 when ignited. The chamber 90 can also include chemicals that react to produce a pressure increase in the chamber 90. At the bottom of the chamber 90 is a sealing member 94. The sealing member 86 acts as a barrier between the chamber 90 and the tubular 68. The sealing member 86 may be formed of a frangible material such as glass or ceramic, a flapper valve, a metal o-ring seal, a blow out plug, etc. During use, the pressure increase in the chamber 90 fractures or otherwise breaks the sealing member 94 and acts upon the fluid F in the tubular member 68. In a manner described previously, the pressure change is transferred via the tubular member 68 to the firing head 66*b*.

In yet other embodiments, the activator 80 can include an electrical generator (not shown) that produces an electrical signal that is conveyed via suitable wires (not shown) in the tubular connector 68 to an electrically actuated firing head 66*b*. In yet another embodiment, the activator 80 can manipulate a mechanical linkage connected to a suitable firing head 66*b*.

Figure 5:
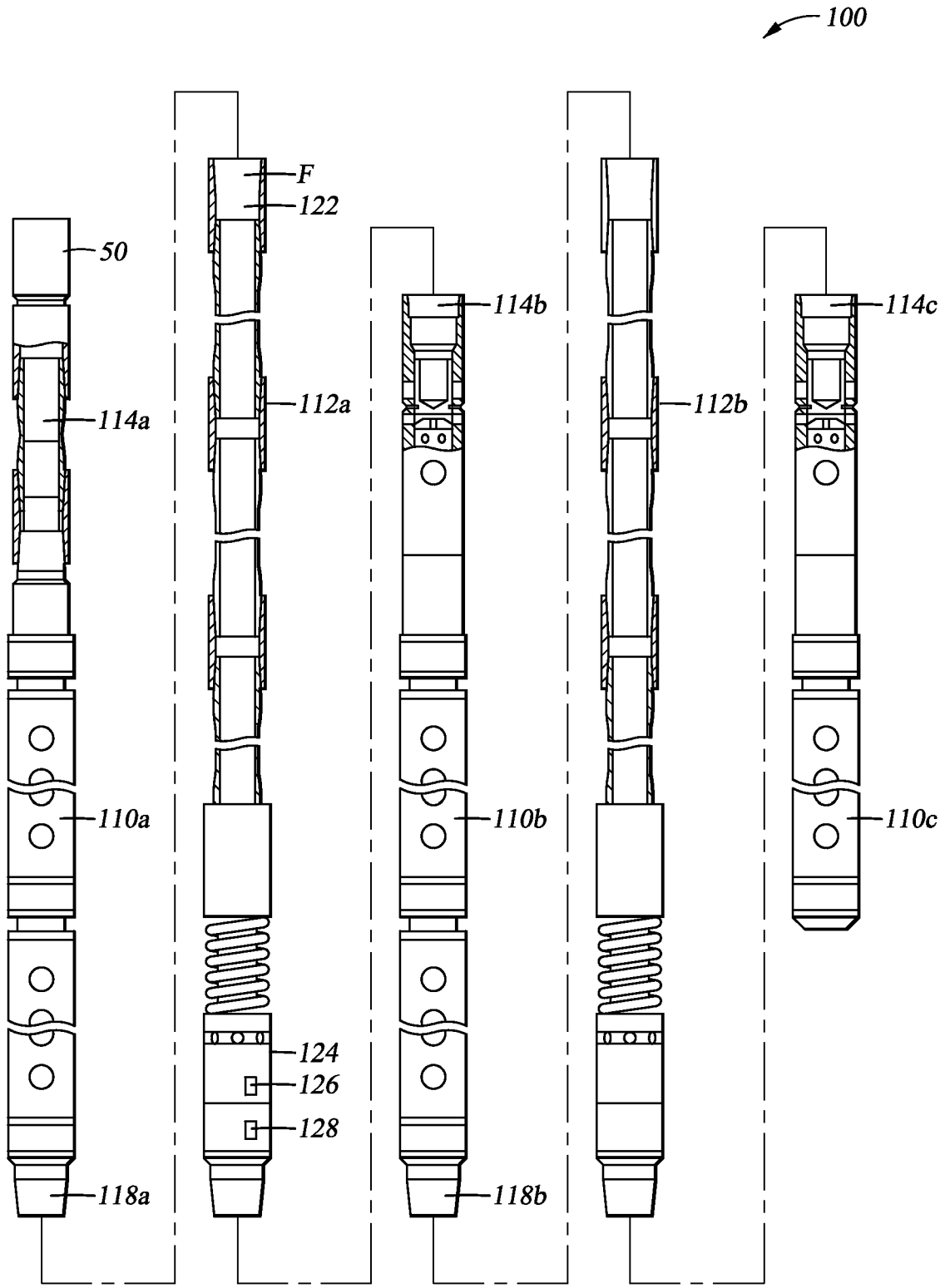
FIG. 5 schematically illustrates another embodiment of the present invention that is adapted to selectively permit transmission of signals to a downhole tool.

Referring now to FIG. 5, there is shown an exemplary perforating gun system 100 made in accordance with one embodiment of the present invention. The gun system 100 includes a plurality of guns 110*a-c* that are connected by tubular connectors 112*a-b*. The guns 110*a-c* each have an associated firing head 114*a-c*, respectively. The firing head 114*a* is a primary firing device that is actuated by a surface signal such as a pressure increase, a bar, an electrical signal, etc. Firing heads 114*b* and 114*c* are actuated by the firing of guns 110*a* and 110*b*, respectively and/or by activator 118*a* and 118*b*, respectively. The gun system 100 is connected to a suitable conveyance device such as tubing or coiled tubing 120. For simplicity, reference is made only to gun 110*a*, activator 118*a*, tubular connector 112*a*, and firing head 114*b* for further discussion with the understanding that the discussion applies to other similarly labeled elements.

Referring now to FIGS. 2, 4B and 5, the activator 118*a* includes an energetic material 92 that is explosively coupled to the charges 64*a* or the detonator cord (not shown) of the gun 110*a*. That is, the charges 64*a* and/or detonator cord (not shown) of the guns 110*a* and the energetic material are arranged such that detonation of the charges 64*a* or the detonator cord (not shown) causes a high order detonation of the energetic material 92. Upon detonation, the energetic material 92 causes a rapid pressure increase within the activator 118*a*. This pressure increase is transmitted to the firing head 114*b* in a manner described below.

The tubular connector 112*a* provides a hydraulic connection between the activator 118*a* and the firing head 114*b* that transmits the pressure change from the activator 118*a* to the firing head 114*b*. The tubular connector 112*a* includes a bore 122 filled with a fluid F. The tubular connector 112*a* can be a substantially sealed unit that is filled at the surface with the fluid such as oil.

In another embodiment, the tubular connector 112*a* is configured to fill selectively itself with wellbore fluids WF using a flow control unit 124. The flow control unit 124 is adapted to (i) allow wellbore fluids WF to fill the tubular connector 112*a* to form the hydraulic connection, (ii) seal the tubular connector 112*a* such that the fluid F in the tubular connector 112*a* is at least temporarily isolated from the wellbore fluids WF, and (iii) drain the fluid F from the bore 122 before the gun system is extracted from the wellbore 38. The flow control unit 124 can include a fill valve 126 and a vent valve 128 which may be one-way check valves, flapper valves, orifices, adjustable ports and other suitable flow restriction devices. The fill valve 124 allows wellbore fluids WF from the wellbore to enter the bore 122 while a weep hole (not shown) allows the air in the bore 122 to escape during filling. The vent valve 128 drains the fluid F into the wellbore 38. In arrangements, the vent valve 128 can be configured to selectively vent fluids F in the bore 122 into the wellbore 38. This selective venting or drain can occur immediately after a pressure increase, after the firing head 114*b* is actuated, upon hydrostatic pressure of the fluid F in the bore 122 or the wellbore fluid WF reaching a preset value, or some other predetermined condition. Moreover, the release of fluids F from the bore 122 can be gradual or rapid. The fluid F may be at high-pressure after being subjected to the pressure increase caused by the gun 110*a* and/or activator 112*a*. Thus, it will be appreciated that allowing the fluid F to drain from the bore 122 before the gun system is extracted from the wellbore 38 can facilitate the safety and ease of handling the gun system at the surface. Moreover, the fill valve 126 and vent valve 128 flow rates are configured to ensure that pressure in the bore 122 remains below the burst pressure of the tubular connector 112*a*. While the fill valve 126 and vent valve 128 are described as separate devices, a single device may also be used. Also, the isolation between the fluid F and the wellbore WF need not be complete. A certain amount of leakage from the bore 112 may be acceptable in many circumstances, i.e., substantial isolation may be adequate.

The firing heads 114*a-c* can fire their respective guns 110*a-c*, respectively, using similar or different activation mechanisms. In one embodiment, all the firing heads 114*a-c* have pressure sensitive sensors that initiate a firing sequence upon detection of a predetermined pressure change in a surrounding fluid. For example, the firing head 114*a* is positioned to detect pressure changes in the wellbore fluid WF and the firing heads 114*b-c* are positioned to detect pressure changes in the fluid F in the adjacent tubular connector 112*a-b*, respectively. In another embodiment, the firing head 114*a* is activated by an electrical signal transmitted from the surface or a bar dropped from the surface while the firing heads 114*b-c* have pressure sensitive sensors positioned to detect pressure changes inside the fluid F in the adjacent tubular connector 112*a-b*, respectively. In yet another embodiment, the firing head 114*a* is activated by an electrical signal transmitted from the surface or a bar dropped from the surface, the firing head 114*b* is activated by a bar released from the activator 118*a*, and the firing head 114*c* has pressure sensitive sensors. It should be appreciated that the activation mechanisms of the firing heads 114*a-c* can be individually selected to address the needs of a given application or wellbore condition. Further, the firing heads 114*a-c* can include time delays to provide control over the sequential firing of the guns 110*a-c*.

Because the fluid F is isolated from the wellbore fluids WF, pressure changes in the wellbore fluids WF will not be transmitted to the firing heads 114*b-c*. Thus, a pressure increase in wellbore fluid WF can be used to activate the firing head 114*a* without also firing the firing heads 114*b-c* because the firing heads 114*b-c* detect pressure of the fluid F in the tubular connectors 114*a-b*.

Referring now to FIGS. 1 and 5, during use, the gun system 100 is assembled at the surface and conveyed into the wellbore via a coiled tubing 50. As the gun system 100 descends into the wellbore 38, the flow control devices 124 allow wellbore fluids WF to fill the tubular connectors 112*a-b* and seal off or close the tubular connectors 112*a-b* once filling is complete. At this point, hydraulic communication via a closed conduit is established between the firing head 114*b* and activator 118*a* and/or gun 110*a* and between the firing head 114*c* and activator 118*b* and/or gun 10*b*.

After the gun system 100 is positioned adjacent the zones to be perforated, a firing signal is transmitted from the surface to the gun system 100. This firing signal can be caused by increasing the pressure of the fluid in the wellbore via suitable pumps (not shown). This pressure increase will activate the firing head 114*a* but not the firing heads 114*b-c*, which are isolated from the pressure of the fluid in the wellbore. Upon receiving the firing signal, the firing head 114*a* initiates a high order detonation that fires the perforating gun 110*a*. This high order detonation also actuates the activator 118*a*, which is explosively coupled to the perforating gun 110*a*, by detonating the energetic material in the activator 118*a*. The pressure increase produced by detonating energetic material in the activator 118*a* travels in the form of a pressure wave or pulse in the fluid F in the tubular connector 112*a* from the activator 118*a* to the firing head 114*b*. Upon sensing the pressure increase, the firing head 114*b* initiates a firing sequence to fire gun 110*b*. These steps are repeated for any remaining guns.

During the firing of the perforating gun system 100, the controller 54 can include a monitoring device for measuring and/or recording parameters of interest relating to the firing sequence. The listening device can be an acoustical tool coupled to the coiled tubing 50, a pressure sensor in communication with the wellbore fluid, or other suitable device. As the gun system 100 fires, each gun 110*a-c*, releases energy such as acoustical waves or pressure waves. By measuring and these waves or pulses, an operator can determine the number of guns 110*a-c* that have fired. It should be appreciated that because embodiments of the present invention provide for sequential firing, the order of the firing of the guns 110*a-c* is already preset. It should also be appreciated that the activators 118*a-b*, firing heads 114*a-b*, and/or tubular connector 112*a-b* can be configured to provide a predetermined amount of time delay between sequential firing to facilitate detection of the individual firing events. Thus, for example, if three distinct firings are measured, then personnel at the surface can be reasonably assured that all guns 110*a-c* have fired. If only two distinct firings are measured, then personnel at the surface are given an indication that a gun may not have fired.

Figure 6:
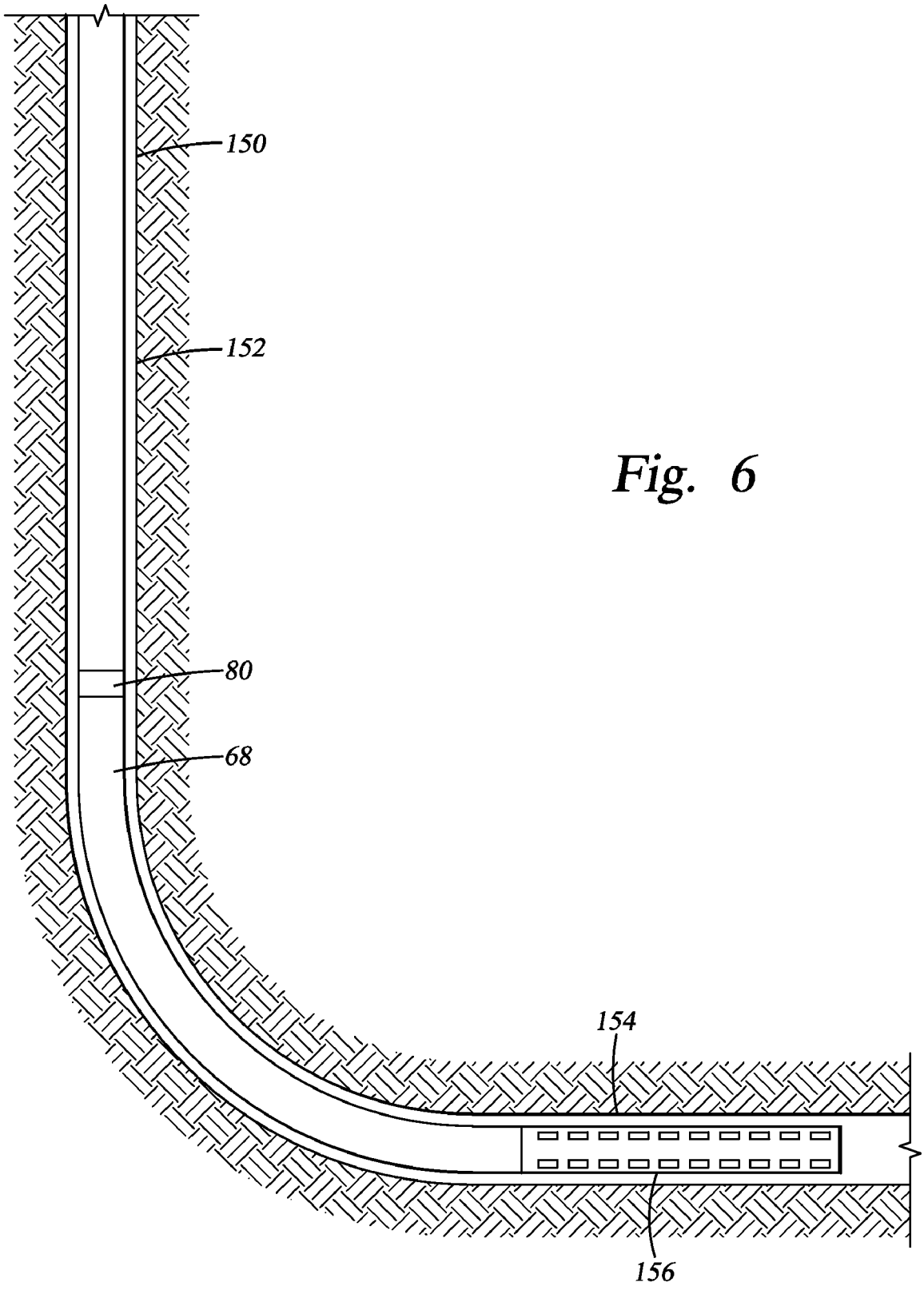
FIG. 6 schematically illustrates another embodiment of the present invention that that is adapted for use in a non-vertical wellbore.

The teachings of the present invention can also be applied to gun systems that do not use the firing of a perforating gun to initiate subsequent gun firings. Referring now to FIG. 6, there is shown a wellbore 150 having a vertical section 152 and a horizontal section 154. A perforating gun 156 is positioned in a horizontal section 154. The gun 156 includes an activator 80 and tubular connector 68 of a configuration previously described. Advantageously, the activator 80 is positioned in the vertical section 152. Thus, a "drop bar" activated firing head may be used to fire the gun 156. Alternatively, as discussed previously, the activator 80 can be actuated explosively, electrically, chemically or by any other suitable method. It should be appreciated that such an arrangement provides for flexible and remote downhole firing of the perforating gun 156.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. For example, while a "top down" firing sequence has been described, suitable embodiments can also employ a "bottom up" firing sequence. Moreover, the activator can be used to supplement the energy release of a perforating gun to initiate the firing sequence rather than act as the primary or sole device for initiating the firing sequence. It is intended that the following claims be interpreted to embrace all such modifications and changes.

The invention claimed is:

1. An apparatus for perforating a wellbore, comprising:

a gun train formed by serially coupling a plurality of gun, the gun train including at least a first gun set and a second gun set;

a tubular connector connecting the first gun set to the second gun set;

an activator operatively coupled to the tubular connector, the activator being configured to detonate in response to a firing of the first gun set and to thereby generate a pressure pulse as an activation signal;

a detonator associated with the second gun set, the detonator being responsive to the activation signal that is conveyed via the connector to the second gun set, the detonator firing the second gun set after receiving the initiation signal; and a vent positioned along the tubular connector, the vent being configured to admit a fluid into the tubular connector and isolate the fluid in the tubular connector from the fluid in the wellbore, wherein the activator is connected to a bottom end of the first gun set and includes a chamber wherein an energetic material is disposed; wherein the connector includes an isolated fluid, and wherein the energetic material is configured to cause a pressure change in the isolated fluid.

2. The apparatus according to claim 1 wherein the second gun set is in hydraulic communication with the fluid in the connector and the first gun set fires after receiving one of (i) a pressure signal transmitted by via the fluid in the wellbore, (ii) an electrical signal transmitted via a conductor coupled to a detonator of the first gun set and (iii) a projectile dropped from the surface.

3. The apparatus according to claim 1 wherein the gun train is conveyed into the wellbore via one of (i) tubing, (ii) coiled tubing and (iii) wireline.

4. The apparatus according to claim 1 wherein the connector includes a flow control unit adapted to selectively fill a bore of the connector with fluid from the wellbore using the vent to provide a hydraulic connection between the first gun set and the second gun set.

5. The apparatus according to claim 1 wherein the gun train includes at least a third gun set connected by a second connector to the second gun set, wherein firing of the second gun set creates an initiation signal conveyed by the second connector to the third gun set, the third gun firing after receiving the activation signal.

6. An apparatus for perforating a wellbore, comprising:

a gun train formed by serially coupling a plurality of gun, the gun train including at least a first gun set and a second gun set;

an activator operatively coupled to a bottom of the first gun set, the activator including a chamber in which an energetic material is disposed, the energetic material being configured to be detonated by a firing of the first gun set, and thereby generate an activation signal;

a detonator associated with the second gun set, the detonator being responsive to the activation signal; and a tubular connector connecting the first gun set to the second gun set, wherein:

(i) the activation signal is conveyed via the connector to the detonator, the second gun set firing in response to receiving the initiation signal, (ii) the connector includes a flow control unit having a vent configured to: (i) open to fill a bore of the connector with fluid from the wellbore close to isolate the fluid in the connector from the fluid in the wellbore to provide the hydraulic connection, wherein the energetic material is configured to cause a pressure change in the isolated fluid, and (ii) open to vent the bore of the connector.

7. The apparatus according to claim 6 wherein the flow control unit includes a vent valve for selectively venting fluid in the connector to the wellbore.

8. An apparatus for perforating a wellbore, comprising:

a gun train formed by serially coupling a plurality of gun, the gun train including at least a first gun set and a second gun set;

a tubular connector connecting the first gun set to the second gun set;

an activator operatively coupled to the tubular connector, the activator being configured to detonate in response to a firing of the first gun set and to thereby generate a pressure pulse as an activation signal;

a detonator associated with the second gun set, the detonator being responsive to the activation signal that is conveyed via the connector to the second gun set, the detonator firing the second gun set after receiving the initiation signal; and a vent positioned along the tubular connector, the vent being configured to admit a fluid into the tubular connector and isolate the fluid in the tubular connector from the fluid in the wellbore, wherein the activator undergoes a high order detonation in response to the firing of the first gun set.

* * * * *